United States Patent [19]

Bobrove

[11] Patent Number: 4,489,842

[45] Date of Patent: Dec. 25, 1984

[54] MAGNETIC LOCK CONTAINER CAP

[75] Inventor: Arthur M. Bobrove, 1539 Walnut Dr., Palo Alto, Calif. 94303

[73] Assignee: Arthur M. Bobrove, Palo Alto, Calif.

[21] Appl. No.: 525,547

[22] Filed: Aug. 22, 1983

[51] Int. Cl.[3] ..... B65D 55/02

[52] U.S. Cl. ..... 215/213

[58] Field of Search ..... 215/211, 213, 295, 296; 220/315, 326

[56] References Cited

U.S. PATENT DOCUMENTS 3,181,718 5/1965 Chancellor ..... 215/213

3,365,088 1/1968 Turner ..... 215/213

*Primary Examiner*—George T. Hall

*Attorney, Agent, or Firm*—Cushman, Darby & Cushman

[57] ABSTRACT

A lockable closure for containers that is held in the locked condition regardless of the orientation of the container, yet is easily releasable in order to permit opening by simple techniques. The closure includes an internal housing in which a vertically movable locking member is retained, and from which a plurality of locking pins radially extend. The neck around the container opening includes pairs of opposed recesses to receive the locking pins when the locking member is in its lowered locking position. Raising of the locking member and release of the lock is accomplished by use of an exteriorly applied magnet that will attract the locking member and raise it out of engagement with the locking recesses in the container neck.

22 Claims, 7 Drawing Figures

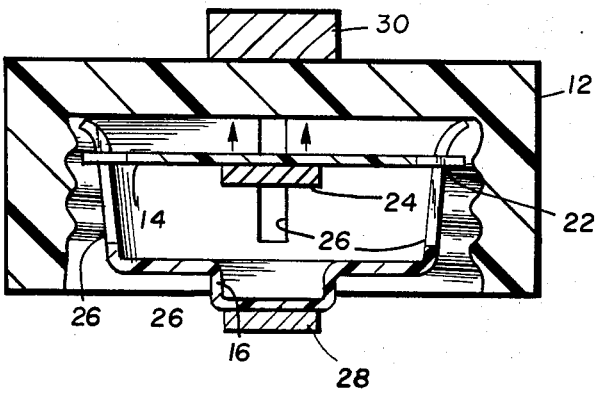
Fig. 2
Fig. 3
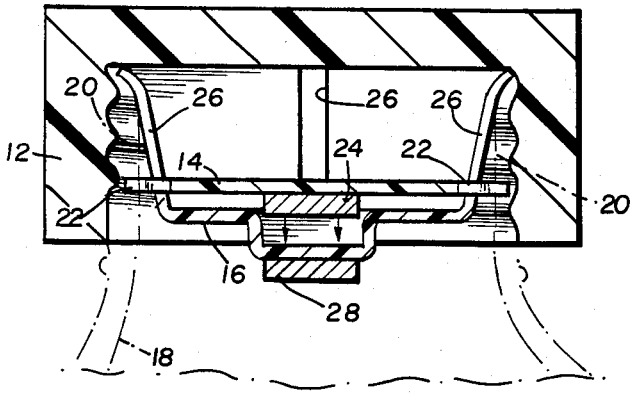
Fig. 4
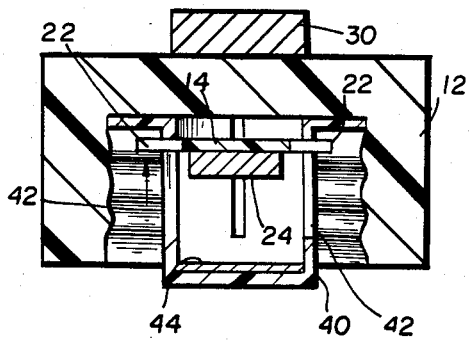
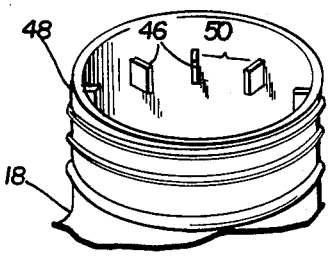
Fig. 6
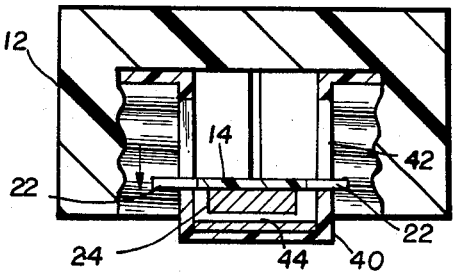
Fig. 5
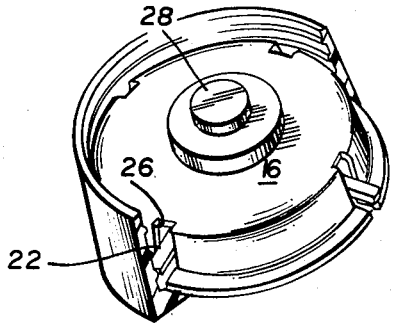
Fig. 7

MAGNETIC LOCK CONTAINER CAP

FIELD OF THE INVENTION

This invention relates to a lockable yet easily releasable cap for use with safety release on bottles, jars or other containers.

BACKGROUND OF THE PRESENT INVENTION

For many years there has been a desire to develop various types of lockable caps or closures for containers that will hold substances that might be harmful or poisonous or various types of medications to which access should be controlled especially if accessible to children.

Exemplary of this type of device is the closure shown in Towns, U.S. Pat. No. 2,964,207. The two types of caps disclosed in this patent are comprised of two parts that are irremovably connected together in a manner that permits relative rotation so that when the sides of the outer member are squeezed inwardly or when the top is pushed downwardly, the two members are joined together to permit simultaneous rotation. When they can rotate simultaneously, then the closure can be either placed on or removed from the container.

Other types of lockable closures have required the use of a key or some other type of exterior release device to open them and exemplary of these closures are those shown in Cumming, U.S. Pat. No. 824,913; Oberle, U.S. Pat. No. 2,820,565 and Glick, U.S. Pat. No. 3,973,687. Each requires use of a key to release a locking device located internally within the closure or within the bottle stopper as in Cumming.

Various uses of magnetic type release devices have also been a subject of U.S. patents. Specifically, Flower, U.S. Pat. No. 3,060,786, relates to a type of connecting nut having a magnetically operated driving means. The nut itself is used to drive a clutch mechanism that is normally out of engagement with drive lugs. The clutch member is comprised of a ferromagnetic material and when a magnet is applied the clutch member is pulled downwardly against the spring and onto the drive lugs allowing the thus engaged drive means to be operated.

Eyster et al, U.S. Pat. No. 4,223,799, also relates to a releasable locking means for closure caps, primarily for fill pipes used on tanks. The cap includes a ferrous material internal locking device which can move a limited distance vertically within the cap. The locking member operates by gravity when no magnet is being applied and as long as the container or tank is upright, the locked device will normally be in its down and locked position. The locking device is comprised of a central cylindrical section having an hexagonal head member at one end of that section and a transversely extending locking pin or bar at the opposite end. This transverse locking pin is designed to cooperate with an inwardly extending annular flange within the fill neck of the container or tank and a series of pairs of diametrically opposed recesses are provided within that annular flange. When the locking device is in its down position due to gravity, the transverse locking pin will fit within one of those pairs of diametrically opposed recesses and prevent rotation of the cap. The subsequent application of a magnet on the exterior of the closure will raise the locking device and, likewise, the pin out from the recesses. Of course, if the container were inverted the locking device would, through gravity, also move out of its locked position and allow closure removal.

Alternatively, the locking device can be comprised of a cylindrical member having a pair of diametrically opposed slots, each of which fit around a pin within the intake tube on which the cap is placed. Alternatively, the locking device can be comprised of a pair of pins, but it can also extend over and engage between them the horizontally extending pin extending radially inwardly from the side wall of the container's inlet. When the container is upright, unlocking is again accomplished by an exteriorly applied magnet. In still another embodiment, the locking device is in the form of a hexagonally shaped cap member that again can slide vertically within the cover with the bottom portion of that cap member being provided with tabs that fit into a flange device in which diametrically opposed pairs of recesses have been provided.

In Montgomery et al, U.S. Pat. No. 2,090,302, a dummy-type fuse is disclosed and in one embodiment, a ferromagnetic arm having a sharpened end is provided within the fuse. A spring forces the sharpened end into contact with the shell of the fuse socket preventing the dummy fuse from being unscrewed. When a magnet is applied to the exterior of the dummy fuse, the arm is pivoted toward the magnet, against the force of the spring, and away from the shell. This releases the sharpened end from against the shell of the fuse socket and allows removal of the dummy fuse. In another series of embodiments, two ferromagnetic cylindrical pellets are provided within a recess between an outer and inner portion of the dummy fuse which are rotatable one relatively to the other. When no magnetic force is applied either externally or internally, the two cylindrical pellets meet at the interface between the inner and outer members and permits the outer member to be rotated freely with respect to the inner member so that the fuse plug cannot be removed. Upon the application of magnet, either from the exterior or from the interior, the two cylindrical pellets are moved so that the lower pellet is positioned across the juncture between the inner and outer portions. This prevents their relative rotation and allows the dummy fuse to either be removed from or placed in the fuse plug opening.

In Berducone, U.S. Pat. No. 3,744,833, a magnetic latch is disclosed. The latch is comprised of a pair of magnets, one fixed and one that is vertically slidable. The two magnets are positioned to be in a mutual repelling relationship so that the slidable magnet is urged into a latching position. Upon the application of a third magnet from the exterior of the latch, the repelling force of the interior magnet is overcome and the slidable latching magnet is moved from its latching position which allows the top of the container to be opened.

It was found that many of the safety designed tops presently being used and available, are in fact child resistant but at the same time extremely difficult for the elderly or people suffering from arthritic problems in their hands to open such closures. This is because many of the child-resistant tops depend upon hand or finger strength or a certain amount of dexterity of the opener's hands. In other words, something other than merely gripping the closure is required.

In addition, it has been noted that closure devices that rely on gravity, such as in Eyster et al, U.S. Pat. No. 4,223,799, do not provide the needed lockability since when containers are oriented in a direction other than that which would produce locking, the container could be easily opened.

Thus, the present invention is designed so that the device is not orientation limited, that is that gravity does not affect its operation even when the container is inverted. Similarly, it was desired to develop a closure device that would only require gripping of a sufficient amount to unscrew the closure rather than to also overcome the effects of a child-resistant mechanism.

SUMMARY OF THE PRESENT INVENTION

The present invention is comprised of a cap member that includes an interior housing which confines and supports a vertically movable disk having a series of outwardly extending tongues, tabs, pins or lugs which in turn are positioned in and extend outwardly beyond an identical number of vertical slots provided in the sides of that housing. Both the interior housing, on its central lower most area beneath the disk, and the disk, at a central point, are provided with magnets oriented so that they are positioned opposite one another and so that their poles will attract one another. These two magnets thus hold the disk in a lower locking position regardless of the orientation of the cap or the container. In addition, the rim of the container or the interior surface of the container's inlet is suitably shaped so that diametrically opposed pairs of retaining slots or recesses are defined which will cooperate with and receive or engage the peripherally extending tongues or pins extending outwardly from the disk when in its lowered and locked position.

The disk can move vertically within the housing and normally, the magnets in the disk and the housing will attract one another and hold the disk in a lowered condition. Thus, one function of the housing is to correctly position a magnet relative to the magnet on the disk so that the two can attract one another to hold the disk in its intended lower (locked) position. When it is desired to place the cap on the container or remove it from the container, a third stronger magnet (relative to the magnet on the housing) is placed on the exterior of the cap which causes the disk to be attracted to that third magnet and thus be raised vertically away from its otherwise attracted position toward the magnet on the housing. This serves to raise the tongues or pins on the disk within the slots in the housing and also in the slots in the container rim. When the disk is in its up (unlocked) position the tongues will be out of engagement with the container's slots or recesses so that they will ride above or clear the upper rim of the container. When in that position, the locking mechanism will be in its unlocked mode and the cap can be removed or applied with only normal effort.

Another function of the interior housing is to protect the disk from being dislodged by the contents in the container should that container be inverted or if for any reason the contents moved toward the cap.

Alternatively, rather than using a second magnet in the housing, a ferromagnetic plate could be provided on the housing or the disk with a magnet on the other member. Thus, the attraction between the metallic plate and the magnet will pull the disk and housing together. Thus, when the cap was on the container and the exterior magnet is not present, the disk will be in its normally lowered and locked position and will be held in that position by the magnetic attraction between the housing and disk. Thus, regardless of the orientation of the container, whether upright or inverted, the lock on the cap will be maintained.

In still another embodiment a spring between the disk and cap can hold the disk in a normally lowered or locked position and the subsequently applied exterior magnet can attract the disk, provided with a suitable ferromagnetic portion or a magnet, and release the locking mechanism.

Other objects, features, and characteristics of the present invention as well as the methods and operation and functions of the related elements of the structure, and to the combination of parts and economies of manufacture, will become more apparent upon consideration of the following description and the appended claims with reference to the accompanying drawings, all of which form a part of this specification, wherein like reference numerals designate corresponding parts in the various figures.

BRIEF DESCRIPTION OF THE DRAWINGS

FIG. 2 shows the cap set forth in FIG. 1 in its unlocked condition;

FIG. 3 shows the cap set forth in FIG. 1 in its locked condition;

FIG. 4 is an alternative embodiment of the present invention in its unlocked condition;

FIG. 5 is a view similar to FIG. 4 showing the second embodiment in its locked position;

FIG. 6 shows an alternative container structure;

FIG. 7 shows a diagrammatic perspective view of the cap with each of the portions set forth in FIG. 1 being joined together.

DETAILED DESCRIPTION OF THE PREFERRED EMBODIMENTS OF THE PRESENT INVENTION

Figure 1:
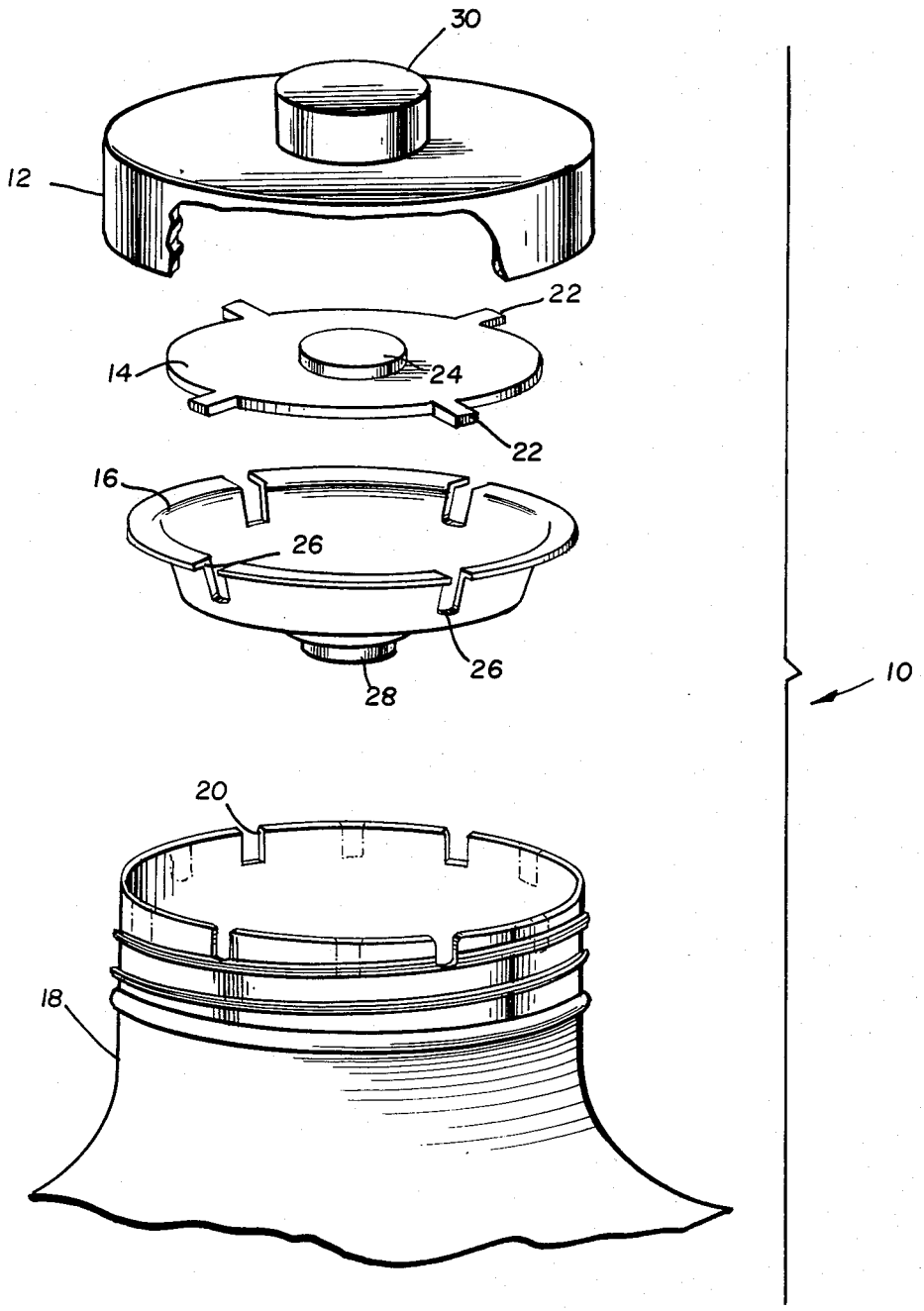
FIG. 1 is a diagrammatic, exploded perspective view of the magnetically lockable and unlockable container cap according to the present invention.

Turning now to the attached drawings, FIG. 1 shows the combination of the container cap and the container in an exploded perspective view. The structure is generally indicated by a bracket at 10 and is specifically comprised of an outer cap 12, a vertically movable disk 14, a housing member 16 and a container 18 which is provided with at least one pair of diametrically opposed slots indicated at 20 in an upstanding neck or wall portion which define the opening to be closed by cap 12.

Disk 14 is provided with a plurality of pins or tongues 22, integrally formed therewith and extending outwardly beyond the periphery of the disk. Further, a magnet 24 is affixed to the center of disk 14.

Housing 16 is provided with a plurality of pairs of opposed grooves or recesses 26 which will compliment the design and number of tongue or pins 22 on disk 14. As shown, the disk 14 has four tongues or two pairs of diametrically opposed tongues. In a similar manner, housing 16 has two pairs of diametrically opposed grooves which will receive lugs 22. As shown in FIG. 1, housing 16 also has a magnet 28 incorporated therewith are arranged with respect to magnet 24 so that the two will be oriented to attract one another together. Magnets 24 and 28 are secured in position by any convenient means, either by glue or by having the disk and housing molded therearound. Further, an additional lock releasing magnet 30 is shown on the top and exterior of cover 12.

With reference now to FIGS. 2 and 3, the unlocked position for the cap is shown in FIG. 2. In this figure, as shown, magnet 30 attracts the disk and specifically magnet 24 and raises it vertically within slots 26 away from the bottom of housing 16 and magnet 28. This raises it out of engagement with slots 20 in bottle 18 and allows cap 12 to be rotated and thus either removed or alternatively placed on the bottle.

Housing member 16 is secured within cap 12 by any convenient means such as glue or by being heat welded into place. In any event, it is only essential that it be secured in place.

With reference to FIG. 3, bottle 18 is shown in phantom and cover 12 is in place on the neck portion. Magnet 30 has been removed and disk 14 is now in its lowered position within housing 16 so that tongues 22 will likewise have dropped within slots 26 and will be in locking engagement with slots 20. Magnets 24 and 28, as indicated above, are oriented such that they attract one another and accordingly, regardless of the orientation of the container 18, disk 14 will be held in the position shown in FIG. 3 due to that mutual attraction. In that position, cap 12 is locked with respect to container 18 and only the application of magnet 30, again as shown in FIG. 2, will raise disk 14 and allow cap 12 to be removed.

An alternative embodiment is shown in FIGS. 4 and 5. A slightly modified housing 40 is used in which vertically extending slots 42 are provided to receive tongues 22 of disk 14. Disk 14 continues to include magnet 24 as in the first embodiment. Housing 40 is also suitably secured within cover 12, by adhesive or heat sealing techniques whichever is most convenient, and located at the bottom of housing 40 is a ferromagnetic plate 44. It should be noted that the position of the magnet and the metallic plate could be reversed. In the unlocked mode, as shown in FIG. 4, magnet 30 is again used to attract disk 14 upwardly thereby raising tongues 22 within slots 42 and out of engagement with bottle 18. In FIG. 5, magnet 30 has been removed and the attractive forces between magnet 24 and plate 44 will pull disk 14 in a downward direction as indicated by the arrow so that again tongues 22 will be in locking engagement with slots 20 within container 18.

With reference to FIG. 6, an alternative structure is shown for container 18. Rather than employing slots 20 as indicated in FIG. 1, radially, inwardly projecting and spaced apart extensions 46 could be provided around the circumference of the interior surface of the neck 48 of container 18 so that pairs of diametrically opposed recesses 50 are formed about that surface. Accordingly, in the locking position as shown in FIGS. 3 and 5, tongues 22 and housing 16 could be appropriately proportioned so that lugs 22 would fit within suitable pairs of recesses 50 between projections 46 and thus prevent rotation and removal of cap 12.

A perspective view of the bottom of the cover according to the present invention is shown in FIG. 7. Specifically the various portions including housing 16, the bottom most magnet 28 and lugs 22 are clearly shown.

With respect to the materials to be used for construction, both the container and the cap 12 as well as housing 16 and disk 14 can all be formed from plastic material with the parts preferably being molded by conventional molding techniques. It should be understood and appreciated, however, that other materials could be used.

As an alternative to the use of plate 44, in FIGS. 4 and 5, a compression or return spring (not shown) could be used between cover 12 and disk 14 for purposes of keeping disk 14 in its down and locked position. Thus, when a suitable magnet would be used on the exterior of the cap, as in the previous embodiments, the effects of such a spring would be overcome and the attractive force between the magnets would again raise disk 14 to an unlocked position allowing cap 12 to be removed from the container.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims, which scope is to be accorded the broadest interpretation so as to encompass all such modifications and equivalent structures.

What I claim is:

1. An unlimited orientation locking cap and container system comprising a container having an opening defined by an upstanding wall portion, an outer cup shaped cap member arranged to close said opening, an inner housing secured within said cap member and including means defining at least one vertically extending slot, locking means positioned within said housing and including at least one locking member projecting outwardly from said at least one slot, said locking means being vertically movable within said housing between a raised unlocked position and a lowered locking position, said upstanding wall portion including means for engageably receiving said at least one locking member when said cap is on said container and said locking member is in its lowered position, means for releasably holding said locking means in its lowered position and means for releasing said releasably holding means.

2. The system as in claim 1, wherein said locking means comprises a disk having a plurality of tabs extending outwardly beyond the periphery of said disk.

3. The system as in claim 1, wherein said inner housing and said locking means respectively include magnetically attractable means.

4. The system as in claim 1, wherein said releasably holding means comprises at least one magnet secured to one of said inner housing or said locking means and a magnetically attractable material on the other.

5. The system as in claim 4, wherein said magnetically attractable material comprises a ferromagnetic layer.

6. The system as in claim 3, wherein each of said locking means and said inner housing include a magnet secured thereto with the magnets being diametrically opposed to one another and oriented so that their poles attract one another.

7. The system as in claim 2, wherein said releasably holding means positively forces said disk away from said outer cup member.

8. The system as in claim 3, wherein said releasing means comprises an additional magnet stronger than said at least one magnet so that when the additional magnet is placed on the exterior of said cap it will cause said locking means to be raised to the unlocked position within the inner housing thereby unlocking the system and permitting removal of the cap.

9. The system as in claim 4, wherein said releasing means comprises an additional magnet stronger than said at least one magnet so that when the additional magnet is placed on the exterior of said cap it will cause said locking means to be raised to the unlocked position within the inner housing thereby unlocking the system and permitting removal of the cap.

10. The system as in claim 1, wherein said cap, locking means, inner housing and container are comprised of a plastic material.

11. The system as in claim 1, wherein said engagably receiving means comprises a plurality of pairs of diametrically opposed upwardly opening grooves.

12. The system as in claim 1, wherein said upstanding wall portion includes an interior vertically extending cylindrical surface and said engagably receiving means comprises a plurality of radially inwardly directed members positioned in a spaced apart manner aruond the circumference of said interior surface.

13. A lockable removable cap for a container comprised of an outer housing suitably designed to fit onto a container, said cap including locking means, mounted within the interior of said cap so as to be slidable in the direction of removal of said cap from the container therein between at least a first and a second position, for cooperating with a portion of the container when said locking means is at said first position to lock the cap thereto, said locking means being normally urged toward said first position.

14. A cap as in claim 13 wherein said locking means comprises a rigid member.

15. A cap as in claim 13 wherein said locking means includes a disk.

16. A cap as in claim 13 further including magnetic means, removably disposably onto said outer housing, for selectively moving said cap to said second position.

17. A cap as in claim 13 further including inner housing means disposed between said locking means and the interior of said container for preventing objects within said container from moving said locking means from said first position.

18. A device for removably sealing an orifice defined by an annular wall, comprising:

outer housing means for engaging with the outer surface of said wall to seal said orifice;

locking means, engageably disposed within said outer housing means and slidably displaceable in the direction of removal of the device from the orifice between at least a first position and a second position, for engaging with the inner surface of said wall when in said first position; and biasing means for urging said locking means toward said first position.

19. A device as in claim 18 wherein said locking means comprises a rigid member.

20. A device as in claim 18 wherein said locking means includes a disk.

21. A device as in claim 18 further including magnetic means, removably disposable onto said outer housing means, for selectively displacing said cap to said second position.

22. A device as in claim 18 further including inner housing means, disposed between said locking means and said orifice, for preventing objects within said orifice from displacing said locking means from said first position.

* * * * *